United States Patent [19]

Jeschke

[11] 4,137,845

[45] Feb. 6, 1979

[54] DEVICE FOR ADJUSTING LATERAL AND CIRCUMFERENTIAL REGISTER IN ROTARY PRINTING MACHINES

[75] Inventor: Willi Jeschke, Heidelberg, Fed. Rep. of Germany

[73] Assignee: Heidelberger Druckmaschinen Aktiengesellschaft, Heidelberg, Fed. Rep. of Germany

[21] Appl. No.: 876,272

[22] Filed: Feb. 9, 1978

[30] Foreign Application Priority Data

Feb. 10, 1977 [DE] Fed. Rep. of Germany ..... 2705522

[51] Int. Cl.[2] ..... B41F 13/14

[52] U.S. Cl. ..... 101/248

[58] Field of Search ..... 101/248, 181

[56] References Cited

U.S. PATENT DOCUMENTS

| | | | |
|---|---|---|---|
| 2,425,914 | 8/1947 | Blackley et al. | 101/248 |
| 2,539,068 | 1/1951 | Funk | 101/248 |
| 2,775,935 | 1/1957 | Reinartz et al. | 101/248 |
| 3,308,752 | 3/1967 | Stevenson | 101/248 |

*Primary Examiner*—J. Reed Fisher
*Attorney, Agent, or Firm*—Herbert L. Lerner

[57] ABSTRACT

Device for adjusting circumferential and lateral register in a rotary printing machine having support frames at opposite drive and operating sides thereof and a plate cylinder drivable by a spur gear at the drive side, including first and second adjusting members on the operating side for turning the plate cylinder radially relative to the spur gear for driving the plate cylinder for circumferential register adjustment and for axially displacing the plate cylinder for lateral register adjustment. An adjusting spindle which extends axially through a bore formed in the plate cylinder is coupled at the operating side to the first adjusting member and is connected, at the drive side, to a threaded member. A thrust bearing is operatively associated with the threaded member and with the spur gear driving the plate cylinder. The spur gear is carried by a coupling and is displaceable axially thereon relative to the plate cylinder by the first adjusting member through the adjusting spindle, the threaded member and the thrust bearing, a rotatable bushing coupled to the second adjusting member at the operating side, a device for axially displacing the plate cylinder together with the adjusting spindle and the spur gear upon rotation of the bushing by the second adjusting member, and a spring located between the plate cylinder and the spur gear applying a force through the adjusting spindle, and through the threaded member, the thrust bearing and the bushing.

6 Claims, 3 Drawing Figures

Figure 1:
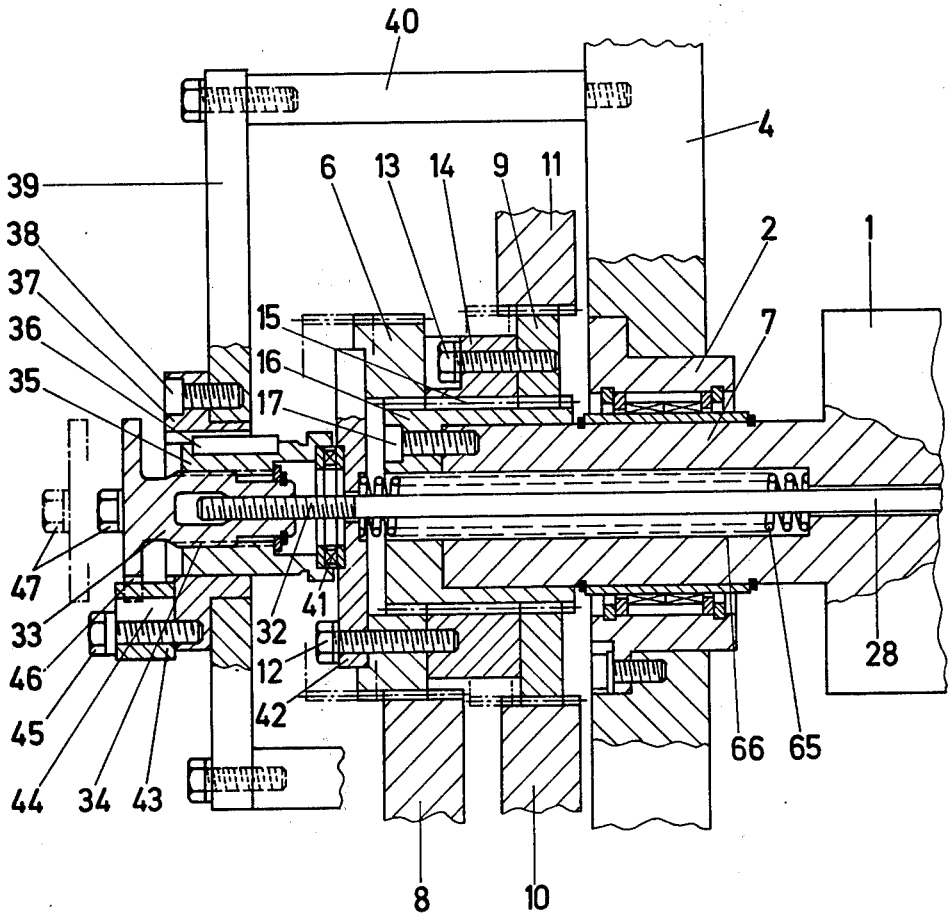

DEVICE FOR ADJUSTING LATERAL AND CIRCUMFERENTIAL REGISTER IN ROTARY PRINTING MACHINES

The invention relates to a device for adjusting circumferential and lateral register in rotary printing machines with the aid of adjusting means which, for effecting circumferential register adjustment, radially turn the plate cylinder by means of coupling surfaces relative to a spur gear driving the plate cylinder and, for effecting lateral register adjustment, displace the plate cylinder axially, the adjusting means being disposed on the operating side of the machine and the plate cylinder being driven with the aid of a straight-toothed spur gear.

In a heretofore known device of this general type (U.S. Pat. No. 2,425,914), circumferential and lateral register are adjusted by means of handwheels and screwthread. The circumferential register is adjusted by means of an interposed sliding bushing which guides the plate cylinder drive wheel, the sliding bushing having external and internal couplings one of which is helical in shape, so that, upon displacement of the sliding bushing, the plate cylinder is turned radially relative to the drive wheel. The drive wheel is not axially displaceable relative to the plate cylinder, but is fastened onto the cylinder journal by means of a fitting or adjusting disc. Upon operation of the lateral register adjustment, the sliding bushing of the plate cylinder drive wheel is also displaced therewith.

Through the rotary movement of the plate cylinder, axial and radial vibrations are transmitted to the devices for adjusting circumferential and lateral register. In the herinaforementioned heretofore known device, these vibrations produce an effect wherein the bearing play in the two adjusting screwthreads, in the inner and outer coupling, at the fitting disc and the ball bearings, produces uncontrolled displacement of the plate cylinder in radial and axial directions. A consequent disadvantage thereof is that this displacement is the direct cause of differences in register. With the present demand for accuracy within a few hundredth of a millimeter, this leads to faults in the printed products which cannot be set right by the printer. With the heretofore known device, the printer is merely able to adjust his circumferential and lateral register to a mean value without being able to correct upwardly or downwardly any deviations caused by vibration. The difference in register caused thereby is further increased with increasing bearing play in the individual adjustment means so that, after the rotary printing machine has been operating for a period, it can no longer be used for high quality work.

It is therefore an object of the invention to provide a device for adjusting circumferential and lateral register in rotary printing machines which minimizes or eliminates the occurrence of radial and axial play in the adjustment means which would otherwise result in differences in register in the printed product.

A further object of the invention is to provide such a register adjusting device while avoiding the necessity for having two couplings in the drive.

Another object of the invention is to provide such a device wherein the adjustment of circumferential and lateral register is capable of being effected independently of one another at the operating side of the machine, and the fixed bearing for the plate cylinder.

It is also an object of the invention to provide such a device wherein the fixed bearing for the plate cylinder is located at the side of the machine opposite to the drive side thereof.

With the foregoing and other objects in view, there is provided, in accordance with the invention, a device for adjusting circumferential and lateral register in a rotary printing machine having a support framework with respective frames at mutually opposite drive and operating sides of the machine and a plate cylinder drivable by a straight-toothed spur gear located at the drive side of the machine, comprising first and second adjusting means disposed on the operating side of the machine, respectively, for turning the plate cylinder radially relative to the spur gear for driving the plate cylinder so as to adjust the circumferential register and for axially displacing the plate cylinder so as to adjust the lateral register, an adjusting spindle extending axially through a bore formed in the plate cylinder, said adjusting spindle being coupled at the operating side of the machine to the first adjusting means and being connected, at the drive side of the machine, to a threaded member, a thrust bearing operatively associated with said threaded member and with the spur gear driving the plate cylinder, the spur gear being carried by a coupling having helical coupling surfaces and being displaceable axially on the coupling relative to the plate cylinder by the first adjusting means through the adjusting spindle, the threaded member and the thrust bearing, a rotatable threaded bushing coupled to the second adjusting means at the operating side of the machine, means for axially displacing the plate cylinder together with the adjusting spindle and the spur gear upon rotation of the threaded bushing by the second adjusting means, and compression spring means disposed between the plate cylinder and the spur gear for applying a force transmissible through the adjusting spindle, as tension member, and through the threaded member, the thrust bearing and the threaded bushing. In fact, the force of the compression springs is transmitted through all of the interposed member of the device according to the invention.

This construction according to the invention utilizes a straight-toothed spur gear that is connected to the plate cylinder by only one coupling surface, so that by this means alone bearing play is already reduced. The plate cylinder is also guided on the operating side of the machine through a thrust bearing, so that load-dependent deformation in the side frame at the drive side of the machine cannot affect the axial position of the plate cylinder. In addition, all adjusting means are braced against one another by means of one or more compression springs in order to eliminate play, so that the negative effect of any bearing play that might exist in the adjusting means is precluded. Another advantage of the invention of the instant application is that, for lateral register adjustment, no modification of the bracing between cylinder, spur gear, and adjusting means occurs.

In accordance with another feature of the invention, to achieve spatial separation of the adjusting means for circumferential and lateral register adjustment, the first adjusting means comprise a first handwheel and first gearing for coupling the first handwheel to the adjusting spindle, and the second adjusting means comprise a second handwheel and second gearing for coupling the second handwheel to the threaded bushing.

In accordance with a further feature of the invention, in order to assist in the elimination of play for lateral register adjustment, the device includes a holder mounted in the frame at the operating side of the machine, the threaded bushing being disposed in the holder, lockwasher means for rendering the threaded-bushing play-free in the holder, and compression spring means for bracing the lockwasher means against the holder.

In accordance with an additional displacement of the register position, the first and second adjusting means comprise respective first and second handwheels, and also included are respective adjusting shafts whereon the first and second handwheels are fastened, and respective adjustable clamping brakes, in turn, surrounding the adjusting shafts.

Without affecting freedom from play, in accordance with an added feature of the invention, the adjusting spindle is formed with a screwthread threadedly engaging in an internal thread formed in the threaded member, the threaded member being also formed with an external thread, an axially displaceable bushing formed with an internal thread wherein the external thread of the threaded member is engaged, and sliding cam means for radially blocking axial displacement of the axially displaceable bushing. The drive gear of the plate cylinder can thus be disconnected without modifying the respective adjustment.

For the remote control of circumferential and lateral register, in accordance with a concomitant feature of the invention, the first adjusting means comprise a first servomotor and transmission gearing for coupling the first servomotor to the adjusting spindle for turning the spindle, and the second adjusting means comprise a second servomotor and transmission gearing for coupling the second servomotor to the threaded bushing for turning the threaded bushing, and including respective means for operating the first and second servomotors in accordance with determined adjustment values. In this case, instead of handwheels, gears are mounted on the adjusting shaft.

Other features which are considered as characteristic for the invention are set forth in the appended claims.

Although the invention is illustrated and described herein as embodied in device for adjusting lateral and circumferential register in rotary printing machines, it is nevertheless not intended to be limited to the details shown, since various modifications and structural changes may be made therein without departing from the spirit of the invention and within the scope and range of equivalents of the claims.

Figure 2:
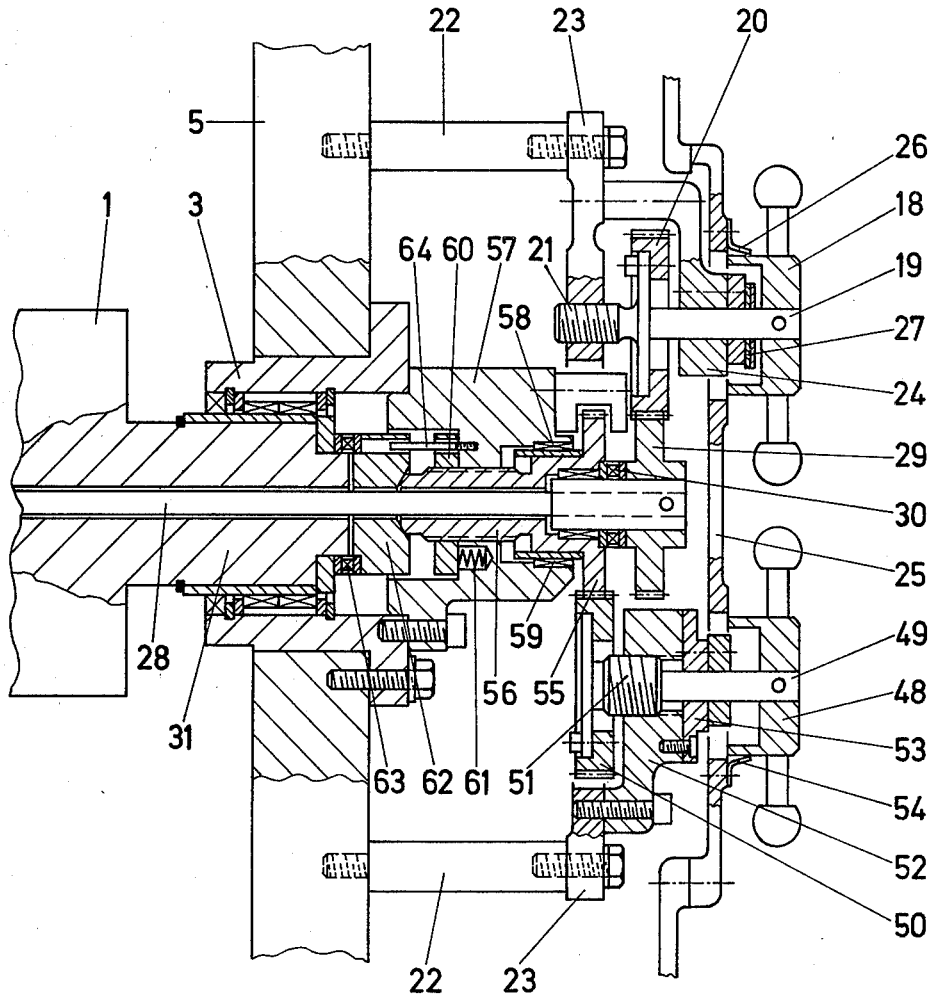
Figure 3:
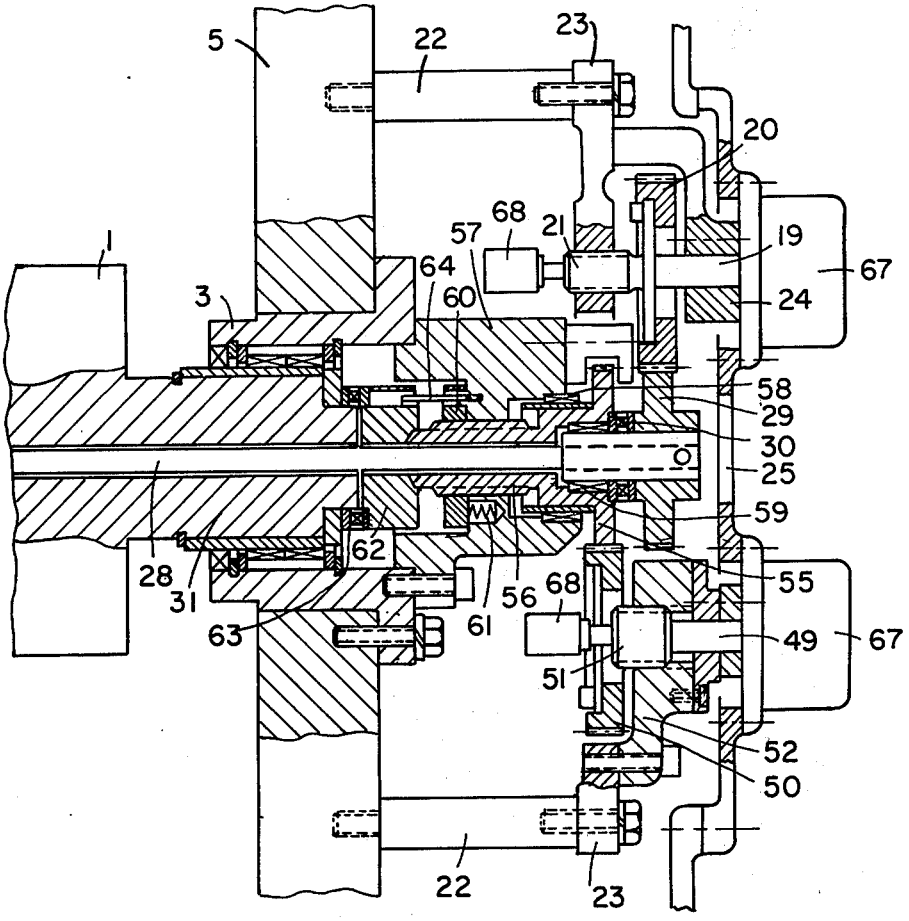

The construction and method of operation of the invention, however, together with additional objects and advantages thereof will be best understood from the following description of specific embodiments when read in connection with the accompanying drawings, in which:

FIG. 1 is a diagrammatic elevational view, partly broken away and partly in section, of a circumferential register adjustment system according to the invention located on the drive side of a rotary printing machine, and FIG. 2 is a diagrammatic elevational view, also partly broken away and partly in section, of a lateral register adjustment system located on the operating side of the rotary printing machine and FIG. 3 is a view similar to FIG. 2 including servomotors in place of handwheels.

Referring now to the figures of the drawing, it is noted that a plate cylinder 1 is rotatably mounted in respective bearings 2 and 3 in the drive side frame 4 of the support framework of a rotary printing machine and in the operating side frame 5 of the support framework. The plate cylinder 1 is driven by a straight-toothed spur gear 6 which is mounted on a journal 7. The spur gear 6 meshes with a gear 8 of the otherwise non-illustrated rotary printing machine drive. Another drive gear 9 meshes, on the one hand, with a gear 10 of a non-illustrated blanket cylinder and, on the other hand, with a gear 11 of a non-illustrated inking unit drive. The two gears 6 and 9 have straight teeth and are fastened by means of screws 12 and 13, respectively, to a member 14. The member 14, in turn, has helical coupling surfaces 15, which engage axially displaceably in coupling surfaces of a coupling 16 fastened onto the journal 7 by screws 17, if the drive gear 9 is likewise provided with coupling surfaces, it can be made free from play by bracing it with the member 14.

For an adjustment of circumferential register, the handwheel 18 (FIG. 2) is turned together with an adjusting shaft 19 and a gear 20. The adjusting shaft 19, at the end thereof, opposite to the end on which the handwheel 18 is mounted, is provided with a screwthread 21 which threadedly engages in a threaded bore formed in a plate 23 fastened to the operating side fram 5 of the rotary printing machine by means of stay bolts 22. When the handwheel 18 is turned, the screwthread 21 is screwed to a greater or lesser depth into the plate 23, whereby the adjusting shaft 19 is axially displaced in the bearing 24 thereof. On a cover 25, there is fastened an indicator 26 from which there can be read the amount of circumferential register adjustment through the rotary movement and axial movement of the handwheel. A clamping brake 27, mounted on the adjusting shaft 19 protects against unintentional turning of the handwheel 18.

The gear 26 meshes with a gear 29 which is fastened onto the adjusting spindle 28 and braced by means of a thrust bearing 30 (FIG. 2). The adjusting spindle 28 passes axially through a journal 31, the plate cylinder 1, and the journal 7 and, at the other end thereof, is formed with a screwthread 32. The screwthread 32 threadedly engages in an internally threaded member 33 (FIG. 1) which, in turn, by an external screwthread 34 also formed thereon, threadedly engages in an axially displaceable bushing 35, which is mounted in a bearing bushing 37 and, by means of a parallel key 36, is secured against rotation, yet axially displaceable. The bearing bushing 37 is fastened by screws 38 to a bridge 39 which, in turn, is mounted by stay or spacer bolts 40 on the drive side frame 4 of the support framework.

When the adjusting spindle 28 is turned, the bushing 35 is axially displaced by means of the threaded bushing 33 and then transmits the axial movement through a thrust bearing 41 to a disc 42 and thence to the drive gears 6 and 9. With the straight toothing thereof, the gears 6 and 9 can execute an axial movement without rotary movement relative to the gears 8, 10 and 11 meshing therewith. During this axial movement, however, the coupling 16 and, consequently, the plate cylinder 1 are turned by means of the helical coupling surfaces 15. The direction of rotation of the plate cylinder 1 is dependent upon the direction of pitch of the helical coupling surfaces 15 and upon the direction of movement of the member 14.

The threaded member 33 is radially blockable by means of a sliding cam 43, so that it can participate only in the axial movement. A slot 44 formed in the sliding cam 43 for passage therethrough of a fastening screw 45 permits radial displacement of the sliding cam 43 outwardly, so that it no longer engages in an appertaining groove 46 formed in the threaded member. It is thus possible for the threaded member 33 to be turned by means of the hexagon head 47 thereof until the bushing 35 and the spur gear 6 therewith are uncoupled from the gear 8 and shifted to the position thereof shown in phantom in FIG. 1. The possibility is thereby provided of uncoupling the plate cylinder 1 together with the respective printing unit from the main drive, in a relatively simple manner.

A second handwheel 48 (FIG. 2) serves for adjusting lateral register and is likewise connected to one end of an adjusting shaft 49, at the other end of which a gear 50 is carried. In addition, the adjusting shaft 49 is formed with a screwthread 51 by which it is moved axially when turned. The screwhead 51 engages in a bearing 52 on which there is also fastened a clamping brake 53 which prevents unintentional turning of the handwheel 48. The value to be adjusted is able to be read from an indicator 54.

The gear 50 meshes with another gear 55 which is disposed on a threaded bushing 56. The threaded bushing 56, by the screwthread thereof, engages in a holder 57 which is braced by the bearing 3 at the operating side frame 5. In addition, the threaded bushing 56 is rotatably and longitudinally displaceably mounted by means of a bearing 58. The adjusting spindle 28 is mounted for rotation in the threaded bushing 56 by means of a bearing 59.

In order to eliminate play from the threaded bushing 56, use is made of a counter or lock washer or disc 60, which can be braced against the holder 57 by compression springs 61.

The adjusting force of the threaded bushing 56 is transmitted to the journal 31 of the plate cylinder 1 by a supporting plate 62 and a thrust bearing 63. An anchor screw 64 prevents the supporting plate 62 from participating in the rotation.

A strong compression spring 65 (FIG. 1), which is disposed in a bore 66 formed inside the journal 7, surrounds the adjusting spindle 28 and is braced through the disc 42 against the spur gear 6 and also against the plate cylinder 1. The forces are then transmitted through the thrust bearing 41, the bushing 35, and the threaded member 33 to the threaded spindle 28. The latter, in turn, is stressed in tension and transmits the force to the gear 29, as shown in FIG. 2, from which the force is then transmitted through the thrust bearing 30, the threaded bushing 56, the supporting plate 62, and the thrust bearing 63 to the journal 31 of the plate cylinder 1. The force circuit of the compression spring 65 is thereby closed. When the threaded bushing 56 is turned by means of the handwheel 48, the plate cylinder 1 is axially displaced relative to the holder 57 and, consequently, relative to the operating side frame 5 of the support framework, the displacement path being compensated by the compression spring 65. During axial displacement of the spur gear 6 for effecting circumferential register adjustment, the spur gear 6 is displaced by the adjusting spindle 28, compensation of the displacement path likewise being effected by means of the compression spring 65. Also, in this regard, the threaded bushing 56 is braced against the operating side frame 5 through the holder 57.

Due to the force of the compression spring 65, all of the adjusting means are made play-free with the exception of the thread of the threaded bushing 56, so that no axial and radial play can occur. The thread of the threaded bushing 56 is made play-free by means of the lock disc or washer 60, so that also, in this regard, axial play is excluded. Thus, rotational oscillations of the plate cylinder 1 cannot occur either radially or axially, so the printing with accurate register is ensured.

It is believed to be readily apparent that it is within the scope of the invention to automate the device for adjusting lateral and circumferential register in rotary printing machines. In this regard, the handwheels 18 and 48 and the gears associated therewith can be replaced by respective conventional servomotors 67 (FIG. 3) with suitable transmission gearing for turning the adjusting spindle 28 and the threaded bushing 56. Any suitable conventional means for determining the adjustment value required and for suitably operating the servomotors so as to effect exact lateral and circumferential register such as position command elements 68, shown in FIG. 3, may be employed in accordance with this automated embodiment of the invention.

There are claimed:

1. Device for adjusting circumferential and lateral register in a rotary printing machine having a support framework with respective frames at mutually opposite drive and operating sides of the machine and a plate cylinder drivable by a straight-toothed spur gear located at the drive side of the machine, comprising first and second adjusting means disposed on the operating side of the machine, respectively, for turning the plate cylinder radially relative to the spur gear for driving the plate cylinder so as to adjust the circumferential register and for axially displacing the plate cylinder so as to adjust the lateral register, an adjusting spindle extending axially through a bore formed in the plate cylinder, said adjusting spindle being coupled at the operating side of the machine to said first adjusting means and being connected, at the drive side of the machine, to a threaded member, a thrust bearing operatively associated with said threaded member and with the spur gear driving the plate cylinder, the spur gear being carried by a coupling having helical coupling surfaces and being displaceable axially on said coupling relative to the plate cylinder by said first adjusting means through said adjusting spindle, said threaded member and said thrust bearing, a rotatable threaded bushing coupled to said second adjusting means at the operating side of the machine, means for axially displacing the plate cylinder together with said adjusting spindle and the spur gear upon rotation of said threaded bushing by said second adjusting means, and compression spring means disposed between the plate cylinder and the spur gear for applying a force transmissible through said adjusting spindle, as tension member, and through said threaded member, said thrust bearing and said threaded bushing.

2. Device according to claim 1 wherein said first adjusting means comprise a first handwheel and first gearing for coupling said first handwheel to said adjusting spindle, and said second adjusting means comprise a second handwheel and second gearing for coupling said second handwheel to said threaded bushing.

3. Device according to claim 1 including a holder mounted in the frame at the operating side of the machine, said threaded bushing being disposed in said holder, lockwasher means for rendering said threaded-bushing play-free in said holder, and compression spring means for bracing said lock-washer means against said holder.

4. Device according to claim 1 wherein said first and second adjusting means comprise respective first and second handwheels, and including respective adjusting shafts whereon said first and second handwheels are fastened, and respective adjustable clamping brakes, in turn, surrounding said adjusting shafts.

5. Device according to claim 1 wherein said adjusting spindle is formed with a screwthread threadedly engaging in an internal thread formed in said threaded member, said threaded member being also formed with an external thread, an axially displaceable bushing formed with an internal thread wherein said external thread of said threaded member is engaged, and sliding cam means for radially blocking axial displacement of said axially displaceable bushing.

6. Device according to claim 1 wherein said first adjusting means comprise a first servomotor and transmission gearing for coupling said first servomotor to said adjusting spindle for turning said spindle, and said second adjusting means comprise a second servomotor and transmission gearing for coupling said second servomotor to said threaded bushing for turning said threaded bushing, and including respective means for operating said first and second servomotors in accordance with determined adjustment values.

* * * * *